US009997817B2

(12) United States Patent
Su

(10) Patent No.: US 9,997,817 B2
(45) Date of Patent: Jun. 12, 2018

(54) FILTER AND ELECTRONIC DEVICE

(71) Applicant: Lenovo (Beijing) Limited, Beijing (CN)

(72) Inventor: Chang Su, Beijing (CN)

(73) Assignee: Lenovo (Beijing) Limited, Singapore (SG)

( * ) Notice: Subject to any disclaimer, the term of this patent is extended or adjusted under 35 U.S.C. 154(b) by 40 days.

(21) Appl. No.: 15/085,418

(22) Filed: Mar. 30, 2016

(65) Prior Publication Data

US 2017/0194682 A1 Jul. 6, 2017

(30) Foreign Application Priority Data

Dec. 30, 2015 (CN) ..... 2015 1 1021336
Dec. 30, 2015 (CN) ..... 2015 1 1025136

(51) Int. Cl.

| | |
|---|---|
| ***H01P 3/00*** | (2006.01) |
| ***H01P 1/20*** | (2006.01) |
| ***H01P 1/203*** | (2006.01) |
| *H01P 3/08* | (2006.01) |
| *H01P 7/00* | (2006.01) |

(52) U.S. Cl.
CPC ..... *H01P 1/2005* (2013.01); *H01P 1/20363* (2013.01)

(58) Field of Classification Search
CPC ..... H01P 1/203; H01P 1/2005; H01P 7/082; H01P 7/086
USPC ..... 333/202, 204, 219
See application file for complete search history.

(56) References Cited

U.S. PATENT DOCUMENTS 7,215,226 B2 * 5/2007 Lee ..... H01P 1/20381 333/204
7,245,196 B1 * 7/2007 Baliarda ..... H01P 1/20381 333/219
7,504,913 B2 3/2009 Yoon et al.
7,971,756 B2 * 7/2011 Wu ..... H01P 1/20381 333/219

(Continued)

FOREIGN PATENT DOCUMENTS

CN 202034473 U 11/2011
CN 102354779 A 2/2012
CN 202550034 U 11/2012

(Continued)

OTHER PUBLICATIONS

Martin Kufa et al., Comparison of Planar Fractal Filters on Defected Ground Substrate, Dec. 2012, RadioEngineering, vol. 21 No. 4, 6 pages.*

(Continued)

*Primary Examiner* — Dean Takaoka
(74) *Attorney, Agent, or Firm* — Ference & Associates LLC

(57) ABSTRACT

Disclosed is a single notch filter, comprising a dielectric layer, a first metal layer and a second metal layer, wherein the first metal layer and the second metal layer are arranged onto two opposite surfaces of the dielectric layer, the first metal layer comprises a metal microstrip patch, the second metal layer comprises a coplanar waveguide plate and a metal grounding plate, and a fractal defected ground body of the coplanar waveguide plate is coupled with the metal microstrip patch based on the dielectric layer. Other embodiments are described and claimed.

23 Claims, 15 Drawing Sheets

(56) References Cited

U.S. PATENT DOCUMENTS

2016/0013533 A1* 1/2016 Chiang ..... H01P 1/20372
333/204

FOREIGN PATENT DOCUMENTS

| | | | | |
|---|---|---|---|---|
| CN | 202550036 | U | | 11/2012 |
| CN | 202550038 | U | | 11/2012 |
| CN | 102820501 | A | | 12/2012 |
| CN | 202712385 | U | * | 1/2013 |
| CN | 202712389 | U | | 1/2013 |
| CN | 202712390 | U | | 1/2013 |
| CN | 202930516 | U | * | 5/2013 |
| CN | 103187599 | A | | 7/2013 |
| CN | 103219963 | A | | 7/2013 |
| CN | 204614908 | U | | 9/2015 |
| DE | 102007021899 | A1 | | 10/2008 |
| JP | 2006020249 | A | | 1/2006 |

OTHER PUBLICATIONS

Petr Vagner et al., A Novel Bandpass Filter Using a Combination of Open-Loop Defected Ground Structure and Half-Wavelength Microstrip Resonators, Sep. 2010, RadioEngineering, vol. 19 No. 3, 5 pages.*

Haiwen Liu et al., A Bandpass Filter Based on Fractal Shaped Defected Ground Structure Resonators for Wireless Communication, 2010, IEEE / ICMMT Proceedings, 3 pages.*

H.W. Liu et al., Dual-mode dual-band bandpass filter using defected ground waveguide, Jun. 2010, Electronic Letters, vol. 46 No. 13, 2 pages.*

* cited by examiner

FILTER AND ELECTRONIC DEVICE

CLAIM FOR PRIORITY

This application claims priority to Chinese Application Nos. 201511021336.7 and 201511025136.9, each filed on Dec. 30, 2015, the contents of which are fully incorporated by reference herein.

TECHNICAL FIELD

The present disclosure relates to the field of electronic devices, and more specifically, to a single notch filter and electronic device. Additionally, the present disclosure relates to the ultra-wideband wireless technologies, and in particular, relates to a filter adjustment method, a filter, and an electronic device.

BACKGROUND

With the rapid development of communication technology, the requirements people put on information transmission systems have become higher and higher. With this background, Ultra-Wideband (UWB) technology has become a research hotspot due to its advantages, such as system simplicity, low cost, low power consumption, fast data transmission, and high safety.

However, since the ultra-wideband communication consumes very high frequency bands (3.1 GHz to 10.6 GHz), within such a frequency band range, customary communications are already present, for example, the C wave band and X wave band for use in satellite communications, wireless local area networks (WLANs), and worldwide interoperability for microwave access (WiMAX). Therefore, how to address the co-channel interference is an important subject in the UWB research, and thus notch ultra-wideband filters, also known as ultra-wide band filters with trapped waves, have become the key of the design. However, the traditional design method for notched UWB filters uses cascades of multiple filters.

However, this design method increases the system volume and the design cost, meanwhile easily leads to mismatching of parts or components and lowers the efficiency of the system. In recent years, some new design concepts have emerged, for example the defected ground structure, via structure or the multi-layer low temperature co-fired ceramic (LTCC) structure. These new design methods, although achieving a specific technical progress, are still defective in terms of large-scale system integration, expansion of the notch variation range, increase of the notch width, and the like critical technologies.

BRIEF SUMMARY

In summary, one aspect provides a single notch filter, comprising: a dielectric layer having a first surface and a second surface, wherein the second surface is disposed opposite the first surface; a first metal layer arranged onto the first surface of the dielectric layer, wherein the first metal layer comprises a metal microstrip patch; and a second metal layer arranged onto the second surface of the dielectric layer, wherein the second metal layer comprises a coplanar waveguide plate and a metal grounding plate, and the coplanar waveguide plate comprises a fractal defected ground body coupled with the metal microstrip patch.

Another aspect provides a device, comprising: a single notch filter; wherein the single notch filter comprises: a dielectric layer having a first surface and a second surface, wherein the second surface is disposed opposite to the first surface; a first metal layer arranged onto the first surface of the dielectric layer, wherein the first metal layer comprises a metal microstrip patch; and a second metal layer arranged onto the second surface, opposite to the first surface, of the dielectric layer, wherein the second metal layer comprises a coplanar waveguide plate and a metal grounding plate, and the coplanar waveguide plate comprises a fractal defected ground body that is coupled with the metal microstrip patch based on the dielectric layer. A further aspect provides a filter, comprising: a metal microstrip patch, a dielectric plate having an upper and a lower surface, a metal ground plate, and a coplanar waveguide structure; wherein the metal microstrip patch applies a microstrip structure, and the metal ground plate applies a defected ground structure; the coplanar waveguide structure is disposed on the metal ground plate, the metal microstrip patch is disposed on the upper surface of the dielectric plate, and the metal ground plate is disposed on the lower surface of the dielectric plate; and the metal microstrip patch is coupled to the metal ground plate in a vertical transition manner.

An additional aspect provides a method, comprising: forming two intersecting resonance frequency points to implement a wide notch according to a coupling and frequency shift relationship based on the relative position between a first split-ring resonator and a second split-ring resonator; wherein a filter comprises: a metal microstrip patch, a dielectric plate, a metal ground plate, and a coplanar waveguide structure; wherein the metal microstrip patch applies a microstrip structure, and the metal ground plate applies a defected ground structure; the metal microstrip patch is coupled to the metal ground plate in a vertical transition manner; and the coplanar waveguide structure is embedded with a first split-ring resonator and a second split-ring resonator; wherein the first split-ring resonator and the second split-ring resonator have the same ring-splitting direction, and the first split-ring resonator and the second split-ring resonator are symmetrically arranged with respect to a central axis of the coplanar waveguide structure.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

BRIEF DESCRIPTION OF THE DRAWINGS

FIG. 5(*b*) illustrates the second-order fractal defected structure of fractal defected ground body as provided in the embodiments of the single notch filter.

FIG. 5(*c*) illustrates the improved second-order fractal defected structure of fractal defected ground body as provided in the embodiments of the single notch filter.

DETAILED DESCRIPTION

Figure 1:
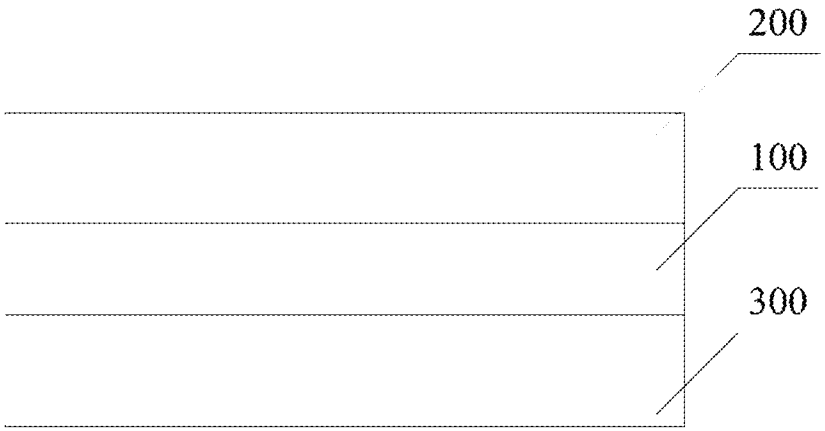
FIG. 1 illustrates one structure of the single notch filter as provided in the embodiments.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

In light of these problems, the disclosure provides a single notch filter which solves the problem in the prior art of the notch structures of UWB filters made up of multiple filter cascades, which lead to larger filter system size and higher design costs, and the tendency to cause mismatch between parts and lower system efficiency.

To achieve this objective, a one embodiment provides: a single notch filter, comprising: a dielectric layer, a first metal layer arranged onto the first surface of the dielectric layer, and a second metal layer arranged onto the second surface, opposite to the first surface, of the dielectric layer. In an embodiment, the first metal layer comprises a metal microstrip patch, the second metal layer comprises a coplanar waveguide plate and a metal grounding plate, and the coplanar waveguide plate comprises a fractal defected ground body that is coupled with the metal microstrip patch based on the dielectric layer.

As for the single notch filter the metal microstrip patch comprises a first patch and a second patch which are symmetrically arranged relative to the center line of the first metal layer; one end of a first part is connected with the first edge of the first metal layer, and the other end of the first part is connected with one end of a second part, and the other end of the second part is symmetrical with a second part of the second patch relative to the center line of the first metal layer; one end of a first part of the second patch is connected with a second part of the second patch, while the other end of the first part of the second patch is connected with the second edge of the first metal layer, and the first edge and the second edge are symmetrically arranged relative to the center line of the first metal layer.

For the single notch filter a stepped impedance resonator is applied to the coplanar waveguide plate.

For the single notch filter the metal grounding plate surrounds, but is not connected with the coplanar waveguide plate.

For the single notch filter the fractal defected ground body is arranged in the center of the coplanar waveguide plate.

For the single notch filter the coplanar waveguide plate of rectangular structure comprises a first part, a second part and a third part which are connected and sequentially arranged according to the long side, the first part is identical to the third part, and the length of the broadside of the first part is less than that of the broadside of the second part.

For the single notch filter the first part of the coplanar waveguide plate overlaps with the second part of the first patch in the metal microstrip patch relative to the projection of the dielectric layer; the third part of the coplanar waveguide plate overlaps with the second part of the second patch in the metal microstrip patch relative to the projection of the dielectric layer.

For the single notch filter the fractal defected ground body is of Y-shaped fractal structure.

For the single notch filter N-order fractalization is conducted on the Y-shaped fractal structure by applying a two-dimensional image fractal model, and N is a positive integer greater than 1.

For the single notch filter the value of relative dielectric constant of the dielectric layer ranges from 1 to 100, and the thickness value range is 0.05-5 mm.

In one embodiment an electronic device, comprises a single notch filter. In an embodiment, the single notch filter comprises: a dielectric layer; a first metal layer arranged onto the first surface of the dielectric layer; and a second metal layer arranged onto the second surface, opposite to the first surface, of the dielectric layer. In an embodiment the first metal layer comprises a metal microstrip patch, the second metal layer comprises a coplanar waveguide plate and a metal grounding plate, and the coplanar waveguide plate comprises a fractal defected ground body that is coupled with the metal microstrip patch based on the dielectric layer.

Based on the above technical solution, in contrast with the prior art, an embodiment provides a single notch filter, comprising a dielectric layer, a first metal layer arranged on the first surface of the dielectric layer, and a second metal layer arranged on the second surface of the dielectric layer. In one embodiment, the first surface is opposite to the second surface, the first metal layer comprises a metal microstrip patch, the second metal layer comprises a coplanar waveguide plate and a metal grounding plate, and the coplanar waveguide plate comprises a fractal defected ground body which is coupled with the metal microstrip patch based on the dielectric layer. In the single notch filter provided by one embodiment, the first metal layer and the second metal layer are arranged on both sides of the dielectric layer respectively, fractal defected ground body is contained in the second metal layer and is coupled with the metal microstrip patch of the first metal layer based on the dielectric layer, and the filter is realized in forms of microstrip and defected ground, so that spatial characteristic can be converted into electromagnetic characteristic based on the space filling property of fractal structure, and filter trap can be realized without a plurality of cascade filters. Moreover, since the fractal defected ground body is much smaller than the volume of the plurality of cascade filters, filter volume is reduced, the parts mismatch problem is solved, and system efficiency is improved.

In view of the above, some embodiments are intended to provide a filter adjustment method, a filter, and an electronic device. According to at least one embodiment, the notch width is increased, the notch variation range is expanded, and the application scope is more extensive. To achieve the above objective, one embodiment discloses a filter. The filter comprises: a metal microstrip patch, a dielectric plate, a metal ground plate, and a coplanar waveguide structure. In one embodiment, the metal microstrip patch applies a microstrip structure, and the metal ground plate applies a defected ground structure; the coplanar waveguide structure is disposed on the metal ground plate, and the metal microstrip patch and the metal ground plate are respectively located on the upper surface and the lower surface of the dielectric plate; and the metal microstrip patch is coupled to the metal ground plate in a vertical transition manner.

In one embodiment, it is signified by the metal microstrip patch being coupled to the metal ground plate in a vertical transition manner that: the metal microstrip patch is in contact with the metal ground plate via the dielectric plate, and the metal microstrip patch is orthogonally vertical to the metal ground plate in terms of space.

In one embodiment, the metal microstrip patch comprises a first microstrip and a second microstrip. In one embodiment the first microstrip and the second microstrip form a left-to-right symmetric structure, and the first microstrip and the second microstrip are both coupled to the metal ground plate via the dielectric plate.

In one embodiment, the coplanar waveguide structure is embedded with a first split-ring resonator and a second split-ring resonator. In one embodiment the first split-ring resonator and the second split-ring resonator have the same ring-splitting direction, and the first split-ring resonator and the second split-ring resonator are symmetrically arranged with respect to a central axis of the coplanar waveguide structure.

In one embodiment, the filter further comprises: a first adjuster, configured to adjust a size and a position of a central frequency point of a passband of the filter by changing sizes of the coplanar waveguide structure and the metal microstrip patch.

In one embodiment, the filter further comprises: a second adjuster, configured to adjust a size and a position of a central frequency point of a passband of the filter by changing the permittivity of the dielectric plate.

In one embodiment, the filter further comprises: a processor, configured to form two intersecting resonance frequency points to implement a wide notch according to a coupling and frequency shift relationship between the first split-ring resonator and the second split-ring resonator at a relative position.

In one embodiment, the filter further comprises: a third adjuster, configured to implement adjustment of a notch central frequency by adjusting lengths of the first split-ring resonator and the second split-ring resonator to expand a frequency variation range of the notch when a central frequency point of a passband of the filter is fixed.

In one embodiment, the coplanar waveguide structure is a stepped impedance resonator.

In one embodiment, the dielectric plate has a relative permittivity of 1 to 100 and has a thickness of 0.05 to 5 mm.

Embodiments further provide a filer adjusting method. In one embodiment, the method comprises: forming two intersecting resonance frequency points to implement a wide notch according to a coupling and frequency shift relationship between the first split-ring resonator and the second split-ring resonator at a relative position. In one embodiment the filter comprises: a metal microstrip patch, a dielectric plate, a metal ground plate, and a coplanar waveguide structure; wherein the metal microstrip patch applies a microstrip structure, and the metal ground plate applies a defected ground structure; the metal microstrip patch is coupled to the metal ground plate in a vertical transition manner; and the coplanar waveguide structure is embedded with a first split-ring resonator and a second split-ring resonator; wherein the first split-ring resonator and the second split-ring resonator have the same ring-splitting direction, and the first split-ring resonator and the second split-ring resonator are symmetrically arranged with respect to a central axis of the coplanar waveguide structure.

In one embodiment, the method further comprises: implementing adjustment of a notch central frequency by adjusting lengths of the first split-ring resonator and the second split-ring resonator to expand a frequency variation range of the notch when a central frequency point of a passband of the filter is fixed.

In one embodiment, the method further comprises: adjusting a size and a position of a central frequency point of a passband of the filter by changing sizes of the coplanar waveguide structure and the metal microstrip patch.

In one embodiment, the method further comprises: adjusting a size and a position of a central frequency point of a passband of the filter by changing a size of a permittivity of the dielectric plate.

Embodiments further an electronic device. In one embodiment, the electronic device comprises the above described filter.

With embodiments, there is provided a wide notch ultra-wideband filter having a compact structure and an excellent performance, and having a wider notch, a greater variation range of the notch central frequency and an extensive application scope. This solves the problem that the conventional filter in the related art is defective in terms of large-scale system integration, expansion of the notch variation range, increase of the notch width and the like critical technologies.

A technical solution of at least one embodiment is described expressly and completely as follows with reference to the accompanying drawings in the embodiments. Obviously, the embodiments described are not all but only some of the embodiments. All other embodiments obtained from the embodiments by those skilled in the art without creative work shall fall within the scope of the embodiments.

Figure 2:
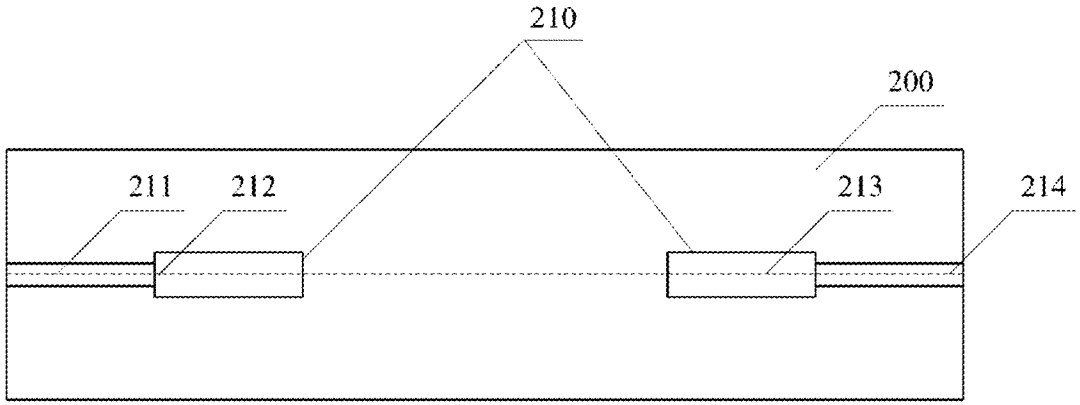
FIG. 2 illustrates the specific structure of the first metal layer as provided in the embodiments of the single notch filter.
Figure 3:
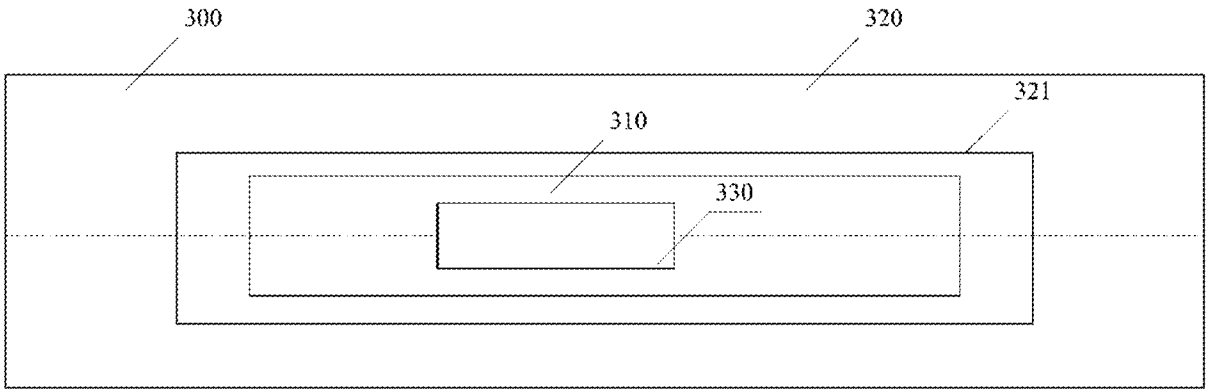
FIG. 3 illustrates the specific structure of the second metal layer as provided in the embodiments of the single notch filter.

Referring to FIG. 1, the figure illustrates one structural diagram of the single notch filter as provided in the embodiments, in which the single notch filter comprises a dielectric layer 100, a first metal layer 200 and a second metal layer 300; the first metal layer 200 is arranged on the first surface of dielectric layer 100, the second metal layer 300 is arranged on the second surface of the dielectric layer 100, and the first surface is opposite to the second surface; the first metal layer 200 comprises a metal microstrip patch 210 (as shown in FIG. 2), the second metal layer 300 comprises a coplanar waveguide plate 310 and a metal grounding plate 320, and the coplanar waveguide plate 310 comprises a fractal defected ground body 330 (as shown in FIG. 3) that is coupled with the metal microstrip patch 210 based on the dielectric layer 100.

In one embodiment, the value of relative dielectric constant of the dielectric layer 100 ranges from 1 to 100, and the thickness value is 0.05-5 mm.

It should be noted that the fractal defected ground body comprises fractal defected structure, and based on the space filling property of the fractal defected structure, the spatial characteristic can be converted into electromagnetic characteristics to realize notch processing, and the center frequency of trapped wave moves toward the low frequency direction by adjusting the spatial size.

$$\lambda_g = \frac{\lambda_0}{\varepsilon_r}$$

$$\lambda_0 = \frac{C}{f_o}$$

$$L_1 \approx \frac{\lambda_g}{4}$$

$$L_2 \approx \frac{\lambda_g}{2}$$

$\in_r$ is the dielectric constant of the dielectric slab; $\lambda_0$ is the corresponding wavelength at the center frequency point of transmission bands of the filter; $\lambda_g$ is the corresponding relative wavelength at the center frequency point for transmission bands of the filter in dielectric slab with dielectric constant as $\in_r$; $f_0$ is the center frequency point of the filter, with c being 3×108 m/s; $L_1$ is the length of 311 and 313 in the coplanar waveguide plate; and $L_2$ is the length of 312 in the coplanar waveguide plate.

Specifically, as the fractal defected ground body 330 is coupled with the metal microstrip patch 210 based on the dielectric layer 100, the size of filter transmission bands and the position of center frequency point can be adjusted by changing the size of dielectric constant of the dielectric slab.

As shown in FIG. 2, which illustrates the specific structure of the first metal layer, the metal microstrip patch 210 comprises a first patch and a second patch which are symmetrically arranged relative to the center line of the first metal layer.

The first patch comprises a first part 211 and a second part 212. One end of the first part is connected with the first edge of the first metal layer 200, and the other end of the first part 211 is connected with one end of the second part 212. The other end of the second part is symmetrical with a second part 213 of the second patch relative to the center line of the first metal layer. One end of a first part 214 of the second patch is connected with the second part 213 of the second patch, and the other end of the first part of the second patch is connected with the second edge of the first metal layer, and the first edge and the second edge are symmetrically arranged relative to the center line of the first metal layer.

FIG. 2 indicates the center shaft of the metal microstrip patch as a dotted line, and the center shaft coincides with the center line of the first metal layer.

To be specific, the metal microstrip patch 210 is of symmetric shaft structure.

The first part and the second part are of rectangular structure.

In one embodiment, the first part applies microstrip line structure with width less than the second part.

As shown in FIG. 3 which illustrates the specific structure of the second metal layer 300, the metal grounding plate 320 surrounds, but is not connected with, the coplanar waveguide plate 310.

Specifically, the fractal defected ground body 330 is arranged in the center of the coplanar waveguide plate 310.

The coplanar waveguide plate 310 is of rectangular structure, and the metal grounding plate 320 is of rectangular frame. In one embodiment, the hollow structure 321 bears the coplanar waveguide plate 310, and the inner side of the metal grounding plate 320 is not connected with the coplanar waveguide plate 310. The spatial structure between the metal grounding plate 320 and the coplanar waveguide plate 310 is established by arranging on the same surface of dielectric layer 100.

Specifically, as the change in size of the metal grounding plate 320 can alter the spatial structure of the single notch filter, the spatial structure of the single notch filter as well as the band width and center frequency point can also be changed by changing the peripheral length and width of metal grounding plate 320 and the length and width of internal hollow structure 321.

A stepped impedance resonator is applied to the coplanar waveguide plate therein.

Figure 4:
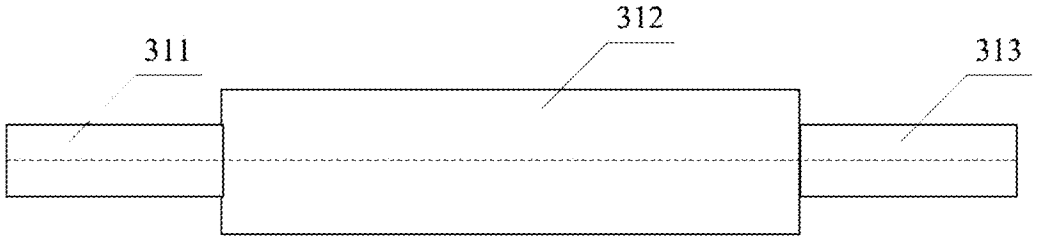
FIG. 4 illustrates the specific structure of the coplanar waveguide plate as provided in the embodiments of the single notch filter.

As shown in FIG. 4, which illustrates the specific structure of the coplanar waveguide plate 310, the coplanar waveguide plate 310 of rectangular structure comprises a first part 311, a second part 312, and a third part 313 which are connected and sequentially arranged according to the broad side. The first part 311 is identical to the third part 313, and the length of the broadside of the first part 311 is less than that of the broadside of the second part 312.

FIG. 4 indicates the center shaft of the coplanar waveguide plate 310 as a dotted line. The center shaft coincides with the center line of the first part 311, the second part 312 and the third part 313.

The size of the first part 311 and the third part 313 of the coplanar waveguide plate 310 is the same as that of the second part 212/214 of the metal microstrip patch 210.

The distance between edges of the two first parts 211/213 of the metal microstrip patch 210 is identical to the length of the second part 312 of the coplanar waveguide plate 310.

It should be noted that, as the change in size of the coplanar waveguide plate 310 can alter the spatial structure of the single notch filter, the spatial structure of the single notch filter as well as band width and center frequency point can also be changed by changing the length and width of the first part/the third part and the second part of the coplanar waveguide plate 310.

As the first part is identical to the third part, the size of the first part and the third part is required to be changed synchronously when the size of the coplanar waveguide plate 310 is changed.

The fractal terrain adopts a Y-shaped fractal structure.

Specifically, N-order fractalization is conducted on the Y-shaped fractal structure by applying a two-dimensional image fractal model, and N is a positive integer greater than 1.

Figure 5:
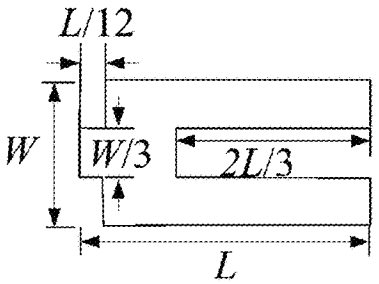
FIG. 5(*a*) illustrates the first-order fractal defected structure of the fractal defected ground body as provided in the embodiments of the single notch filter.
Figure 5:
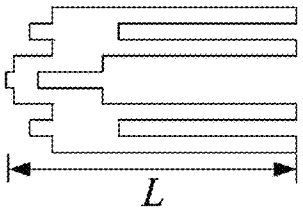
Figure 5:
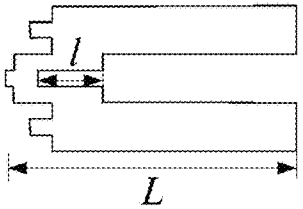

In the schematic diagram for the first-order fractal defected structure of fractal defected ground body 330 as shown in FIG. 5(*a*), the Y-shaped structure is composed of three parts. By changing the length (L) and width (W) in the Y-shaped structure, the spatial structure of the single notch filter can be changed.

In the schematic diagram for the second-order fractal defected structure of fractal defected ground body 330 as shown in FIG. 5(*b*), the second-order Y-shaped structure is obtained by combining three Y-shaped structures. By changing the length (L) and width (W) in the Y-shaped structure, the spatial structure of the single notch filter can be changed.

In the schematic diagram for the improved second-order fractal defected structure of fractal defected ground body 330 as shown in FIG. 5(*c*), a Y-shaped structure is present in the structure. By changing the microstrip line length (l) of the Y-shaped structure, the spatial structure of the single notch filter can be changed.

L in the improved second-order fractal defected structure is fixed, which means the center frequency point of filter transmission band is fixed. By simply adjusting the size of microstrip line length (l) of the Y-shaped fractal defected structure, trap center frequency can be adjusted from 4.94 GHz to 7.20 GHz, so as to expand the variation range of notch frequency.

Specifically, when the size of l changes from 0 to 1.8 mm, the notch center frequency is adjusted from 4.94 GHz to 7.20 GHz. The larger the value of l is, the smaller the filter frequency of the UWB filter will be.

Figure 6:
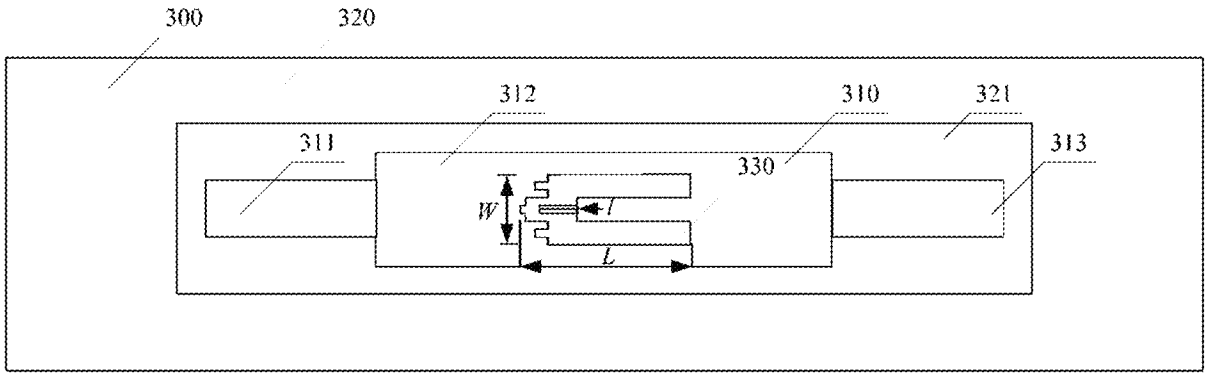
FIG. 6 illustrates the specific structure of the second metal layer with improved second-order fractal defected structure as provided in the embodiments of the single notch filter.

FIG. 6 illustrates the specific structure of the second metal layer with improved second-order fractal defected structure.

Figure 7:
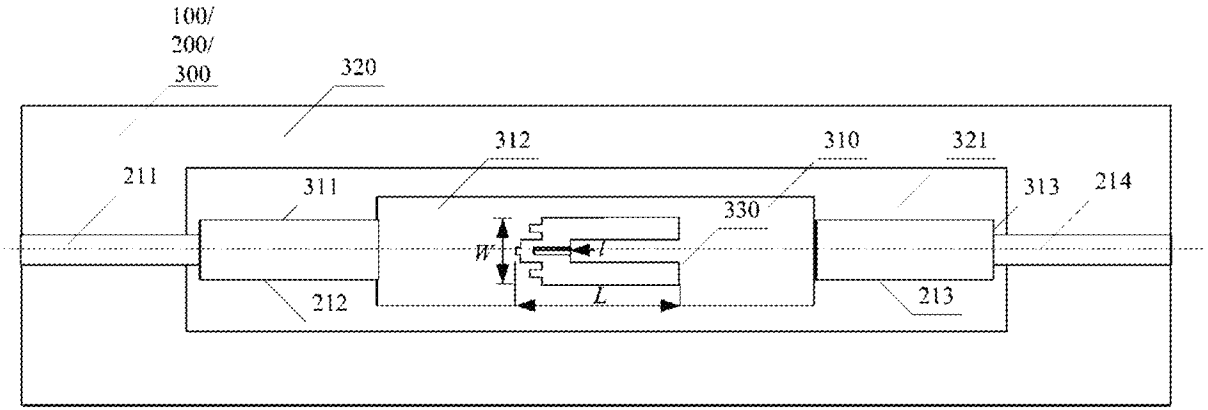
FIG. 7 illustrates another structure of the single notch filter as provided in the embodiments.

FIG. 7 illustrates another structure of the single notch filter, which comprises a dielectric layer 100, a first metal layer 200 and a second metal layer 300;

FIG. 7 shows a perspective view looking from the top, where the first part 311 of the coplanar waveguide plate 310 overlaps with the second part 212 of the first patch in the metal microstrip patch 210 relative to the projection of the dielectric layer 100. The third part 313 of the coplanar waveguide plate overlaps with the second part 214 of the second patch in the metal microstrip patch relative to the projection of the dielectric layer.

It should be noted that, through the above-mentioned projection overlapping mode, the fractal defected ground body 330 is coupled with the metal microstrip patch 210; the fractal defected ground body 330 is coupled with the metal microstrip patch 210 in the manner of vertical transition; and in addition, the metal microstrip patch 210 is coupled with the metal grounding plate 320 and coplanar waveguide plate 310 in the manner of vertical transition.

Besides, in the single notch filter provided in the application, the first metal layer and the second metal layer are arranged on both sides of the dielectric layer respectively, fractal defected ground body is contained in the second metal layer and is coupled with the metal microstrip patch of the first metal layer based on the dielectric layer, and the filter is realized in forms of microstrip and defected ground, so that spatial characteristic can be converted into electromagnetic characteristic based on the space filling property of fractal structure, and filter trap can be realized without a plurality of cascade filters. Moreover, as the fractal defected ground body is much smaller than the volume of the plurality of cascade filters, filter volume is reduced, parts mismatch problem is solved, and system efficiency is improved.

The single notch filter is described in detail in the embodiments provided herein. Also provided is an electronic device with the single notch filter. Specific embodiments are provided as follows for a detailed description.

Figure 8:
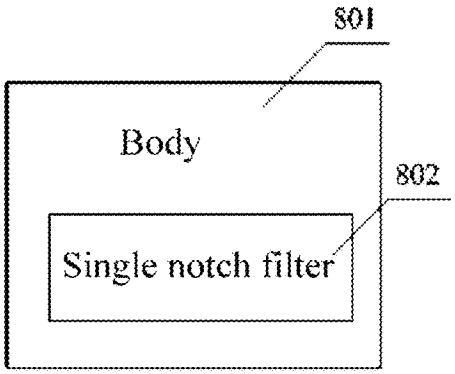
FIG. 8 illustrates the structure of an electronic device as provided in the embodiments.

Referring to FIG. 8, the figure illustrates the structure of an electronic device as provided in the embodiments, and the electronic device comprises a body 801 and a single notch filter 802. In one embodiment, the body is used for carrying the single notch filter 802. The single notch filter 802 comprises: a dielectric layer, a first metal layer arranged onto the first surface of the dielectric layer, and a second metal layer arranged onto the second surface, opposite to the first surface, of the dielectric layer. In one embodiment, the first metal layer comprises a metal microstrip patch, the second metal layer comprises a coplanar waveguide plate and a metal grounding plate, and the coplanar waveguide plate comprises a fractal defected ground body that is coupled with the metal microstrip patch based on the dielectric layer.

In one embodiment, the metal microstrip patch comprises a first patch and a second patch which are symmetrically arranged relative to the center line of the first metal layer. One end of a first part is connected with the first edge of the first metal layer, and the other end of the first part is connected with one end of a second part, and the other end of the second part is symmetrical with a second part of the second patch relative to the center line of the first metal layer. One end of a first part of the second patch is connected with a second part of the second patch, while the other end of the first part of the second patch is connected with the second edge of the first metal layer, and the first edge and the second edge are symmetrically arranged relative to the center line of the first metal layer.

In one embodiment, a stepped impedance resonator is applied to the coplanar waveguide plate.

In one embodiment, the metal grounding plate surrounds, but is not connected with the coplanar waveguide plate.

In one embodiment, the fractal defected ground body is arranged in the center of the coplanar waveguide plate.

In one embodiment, the coplanar waveguide plate of rectangular structure comprises a first part, a second part and a third part which are connected and sequentially arranged according to the long side, the first part is identical to the third part, and the length of the broadside of the first part is less than that of the broadside of the second part.

In one embodiment, the first part of the coplanar waveguide plate overlaps with the second part of the first patch in the metal microstrip patch relative to the projection of the dielectric layer; the third part of the coplanar waveguide plate overlaps with the second part of the second patch in the metal microstrip patch relative to the projection of the dielectric layer.

In one embodiment, the fractal defected ground body adopts a Y-shaped fractal structure.

In one embodiment, N-order fractalization is conducted on the Y-shaped fractal structure by applying a two-dimensional image fractal model, and N is a positive integer greater than 1.

In one embodiment, the value of relative dielectric constant of the dielectric layer ranges from 1 to 100, and the thickness value is range 0.05 to 5 mm.

In the description, each embodiment, described in a progressive manner, focuses on its differences from other embodiments, thus for similar and identical parts between embodiments, these can be understood by cross-referencing each other. For devices provided in the embodiment, the descriptions are brief, as they correspond to the method provided in the embodiments. Please see the description of the method for relevant information.

Those skilled in the art should be able to implement or use the embodiments after reviewing the description of the embodiments provided above. Various modifications of these embodiments shall be apparent to a person skilled in the art, and the general principles defined herein can also be implemented in other embodiments without departing from the spirit or scope of the embodiments. Accordingly, the present invention will not be limited to the embodiments demonstrated herein, but shall encompass the broadest scope that is consistent with the principle and novelty provided herein.

For better and detailed understanding of the features and technical content of the embodiments, the implementation of some embodiments are illustrated in detail with reference to the accompanying drawings. The accompanying drawings are merely for illustration and reference, but are not intended to limit the present disclosure.

Figure 9:
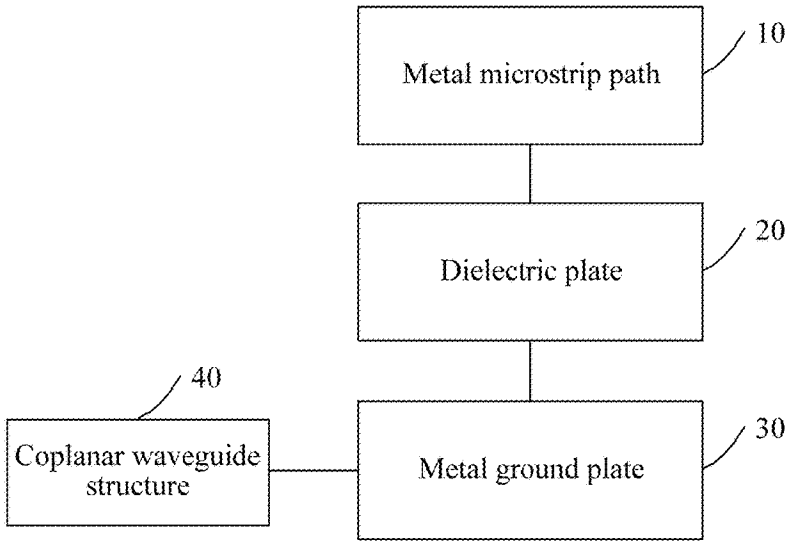
FIG. 9 illustrates a schematic structural diagram of a filter according to an embodiment.

One embodiment provides a filter. FIG. 9 is a schematic structural diagram of a filter according to an embodiment. As illustrated in FIG. 9, the filter comprises: a metal microstrip patch 10, a dielectric plate 20, a metal ground plate 30, and a coplanar waveguide structure 40; wherein the metal microstrip patch 10 applies a microstrip structure, and the metal ground plate 30 applies a defected ground structure. In one embodiment, the metal ground plate 30 is provided with the coplanar waveguide structure 40, and the metal microstrip patch 10 and the metal ground plate 30 are respectively arranged on the upper surface and the lower surface of the dielectric plate 20; and the metal microstrip patch 10 is coupled to the metal ground plate 30 in a vertical transition manner.

In one embodiment, it is signified by the metal microstrip patch 10 being coupled to the metal ground plate 30 in a vertical transition manner that: the metal microstrip patch 10 is in contact with the metal ground plate 30 via the dielectric plate 20, and the metal microstrip patch 10 is orthogonally vertical to the metal ground plate 30 in terms of space.

The metal microstrip patch 10 is coupled to the metal ground plate 30 via the dielectric plate 20.

To be specific, it is signified by the metal microstrip patch 10 being orthogonally vertical to the metal ground plate 30 in terms of space that: the metal microstrip patch 10 is of a three-dimensional structure, and in a spatial coordinate system, the metal microstrip patch 10 is vertical to a plane in the direction of Z axis where the metal ground plate 30 is located.

In one embodiment, the metal microstrip patch 10 comprises a first microstrip 101 and a second microstrip 102; wherein the first microstrip 101 and the second microstrip 102 form a left-to-right symmetric structure, and the first microstrip 101 and the second microstrip 102 are both coupled to the metal ground plate 30 via the dielectric plate 20.

Figure 10:
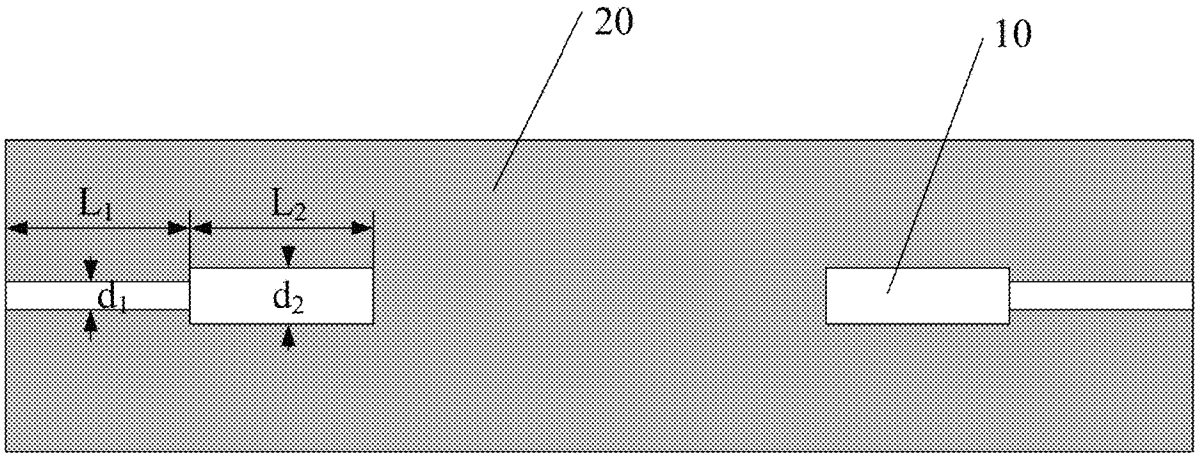
FIG. 10 illustrates a schematic planar diagram of a metal microstrip patch and a dielectric plate according to an embodiment.

FIG. 10 illustrates a schematic planar diagram of a metal microstrip patch and a dielectric plate according to an embodiment. As illustrated in FIG. 10, the first microstrip 101 and the second microstrip 102 form a left-to-right symmetric structure. Both the first microstrip 101 and the second microstrip 102 are formed of two parts, wherein one part is thick (for ease of description, this part is referred to as a thicker end hereinafter) and has a length of L2 and a width of d2, and the other part is thinner (for ease of description, this part is referred to as a thinner end hereinafter) and has a length of L1 and a width of d1.

In one embodiment, a wide side d1 of the thinner end is aligned with a wide side of the upper surface of the dielectric plate 20; a central axis of the first microstrip 101 is vertical to the wide side of the upper surface of the dielectric plate 20; and a central axis of the second microstrip 102 is vertical to the wide side of the upper surface of the dielectric plate 20.

Figure 11:
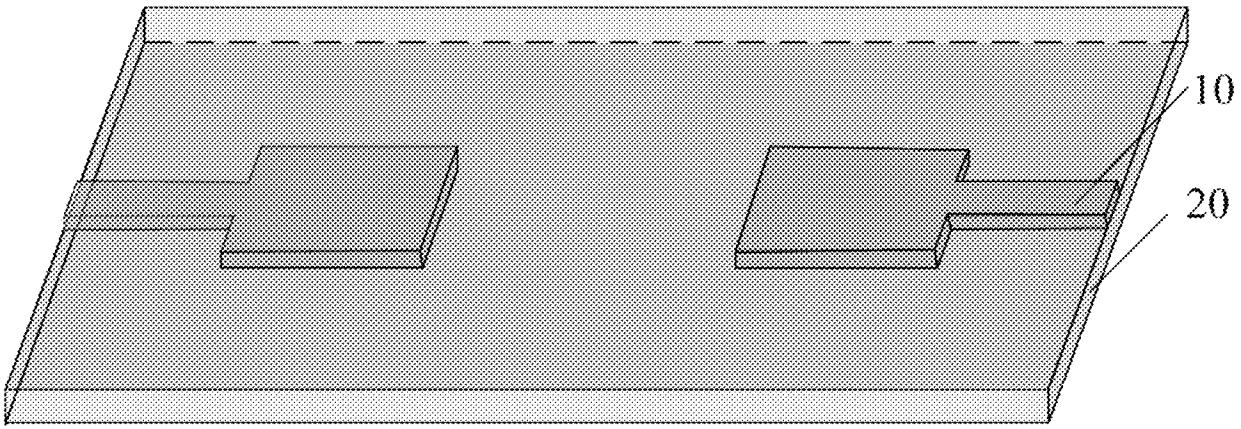
FIG. 11 illustrates a schematic three-dimensional diagram of the metal microstrip patch and the dielectric plate according to an embodiment.

FIG. 11 is a schematic three-dimensional diagram of the metal microstrip patch and the dielectric plate according to an embodiment. As illustrated in FIG. 11, the metal microstrip patch 10 is arranged over the dielectric plate 20.

In one embodiment, the coplanar waveguide structure 40 is embedded with a first split-ring resonator 41 and a second split-ring resonator 42. In one embodiment, the first split-ring resonator 41 and the second split-ring resonator 42 have the same ring-splitting direction, and the first split-ring resonator 41 and the second split-ring resonator 42 are symmetrically arranged with respect to a central axis of the coplanar waveguide structure 40.

Figure 12:
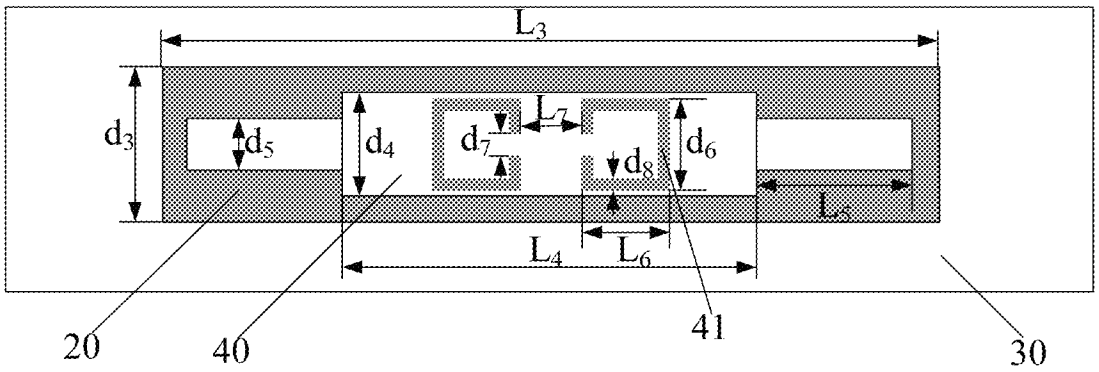
FIG. 12 illustrates a schematic planar diagram of a metal ground plate and a dielectric plate according to an embodiment.

FIG. 12 is a schematic planar diagram of a metal ground plate and a dielectric plate according to an embodiment. As illustrated in FIG. 12, the dielectric plate 20 has a length of L3 and a width of d3. A coplanar waveguide structure 40 is arranged on the metal ground plate 30. The coplanar waveguide structure 40 is formed of three parts. An intermediate part is thicker and two end parts are thinner, and thus the coplanar waveguide structure 40 is of a rolling pin-type structure. The intermediate portion has a length of L4 and a width of d4. The two end parts both have a length of L5 and a width of d5. The first split-ring resonator 41 and the second split-ring resonator 42 both have a length of L6, a width of d6 and a thickness of d8. The first split-ring resonator 41 and the second split-ring resonator 42 are both provided with an opening having a size of d7, and the two openings are distal from each other at a spacing of L7.

Figure 13:
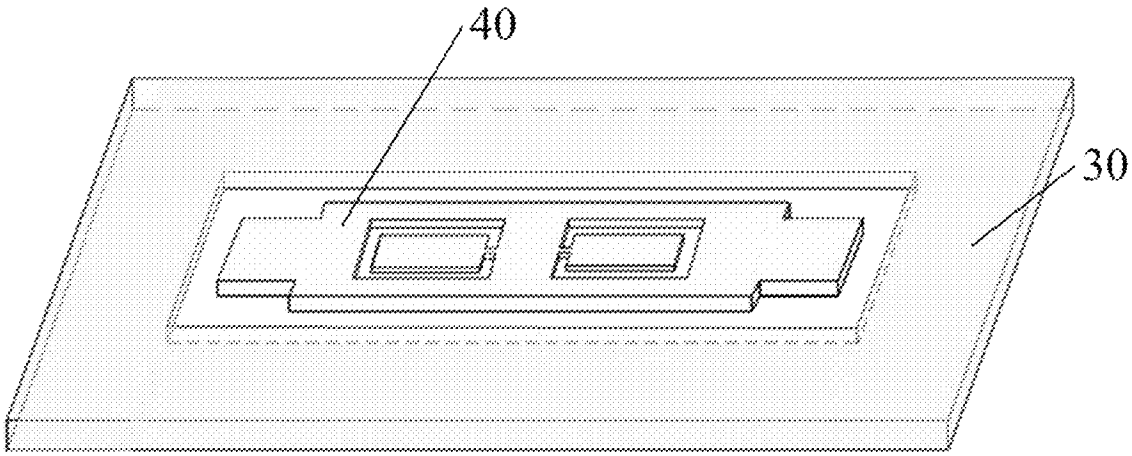
FIG. 13 illustrates a schematic three-dimensional diagram of the metal ground plate according to an embodiment.

FIG. 13 is a schematic three-dimensional diagram of the metal ground plate according to an embodiment. As illustrated in FIG. 13, the metal ground plate 30 is of a hollow structure, and the coplanar waveguide structure 40 is arranged in the hollow part.

Figure 14:
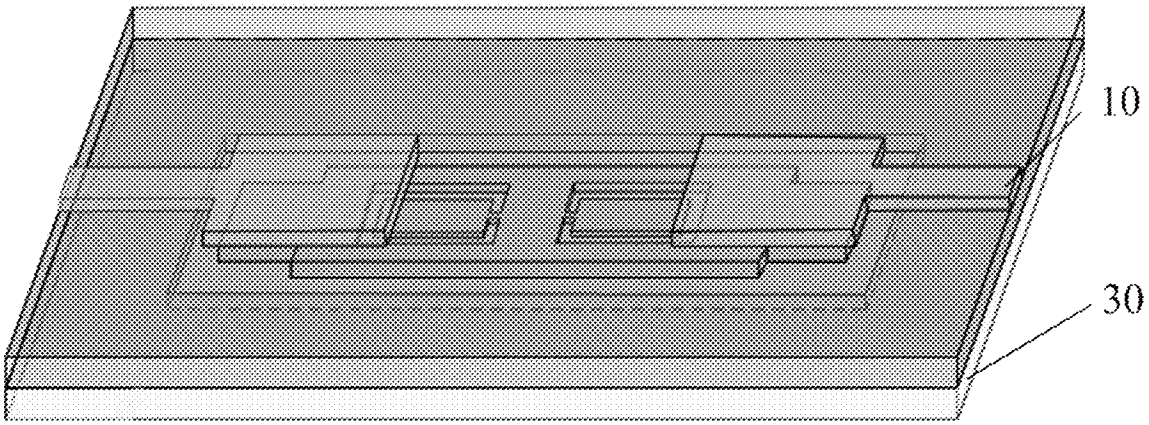
FIG. 14 illustrates a schematic overall structural diagram of the filter according to an embodiment.

FIG. 14 is a schematic overall structural diagram of the filter according to an embodiment. As illustrated in FIG. 14, the filter is mainly divided into three layers. The first layer is the metal microstrip path 10, the second layer is the dielectric plate 20, and the third layer is the metal ground plate 30. The metal microstrip patch 10 is arranged over the dielectric plate 20, and the metal ground plate 30 is arranged below the dielectric plate 20.

In the filter according to this embodiment, since the filter has a reasonable arrangement of various components or parts, the internal components in the filter form a compact structure. This laid a solid basis for a wide notch ultra-wideband filter having an excellent performance, and having a wider notch, a greater variation range of the notch central frequency and an extensive application scope.

Figure 15:
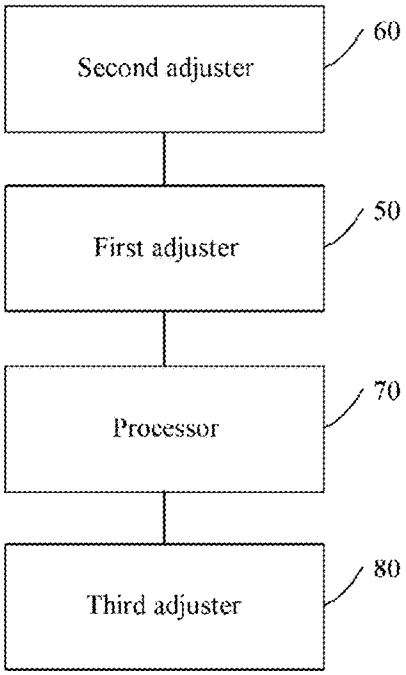
FIG. 15 illustrates a schematic composition structural diagram of another filter according to an embodiment.

Based on the structure of the above described filter, embodiments further provides a filter. FIG. 15 is a schematic structural diagram of another filter according to an embodiment. As illustrated in FIG. 15, the filter comprises: a first adjuster 50, configured to adjust a size and a position of a central frequency point of a passband of the filter by changing sizes of the coplanar waveguide structure 40 and the metal microstrip patch 10.

In one embodiment, the filter further comprises: a second adjuster 60, configured to adjust a size and a position of a central frequency point of a passband of the filter by changing a size of a permittivity of the dielectric plate 20.

In one embodiment, the filter further comprises: a processor 70, configured to form two intersecting resonance frequency points to implement a wide notch according to a coupling and frequency shift relationship between the first split-ring resonator 41 and the second split-ring resonator 42 at a relative position.

In one embodiment, the filter further comprises: a third adjuster 80, configured to implement adjustment of a notch central frequency by adjusting lengths of the first split-ring resonator 41 and the second split-ring resonator 42 to expand a frequency variation range of the notch when a central frequency point of a passband of the filter is fixed.

To be specific, the first split-ring resonator 41 and the second split-ring resonator 42 may both generate a resonance frequency point. However, since the first split-ring resonator 41 is distal from the second split-ring resonator 42, frequency shift of the resonance frequency point may be caused, which expands the frequency band and thus implements the wide notch.

In one embodiment, the coplanar waveguide structure 40 is a stepped impedance resonator.

In one embodiment, the stepped impedance resonator is generally a multi-step impedance resonator.

In practical production process of the product, the relative permittivity and thickness of the dielectric plate 20 may be defined according to the actual needs. For example, the dielectric plate 20 has a relative permittivity of 1 to 100 and has a thickness of 0.05 to 5 mm.

This embodiment provides a wide notch ultra-wideband filter having a compact structure and an excellent performance, and having a wider notch, a greater variation range of the notch central frequency and an extensive application scope. This solves the problem that the conventional filter in the related art is defective in terms of large-scale system integration, expansion of the notch variation range, increase of the notch width and the like critical technologies.

Based on the structure of the filter as illustrated in FIG. 9, an embodiment further provides an adjuster adjusting method. The method comprising: forming two intersect resonance frequency points to implement a wide notch according to a coupling and frequency shift relationship between the first split-ring resonator 41 and the second split-ring resonator 42 at a relative position.

To be specific, the first split-ring resonator 41 and the second split-ring resonator 42 may both generate a resonance frequency point. However, since the first split-ring resonator 41 is distal from the second split-ring resonator 42, frequency shift of the resonance frequency point may be caused, which expands the frequency band and thus implements the wide notch.

When a spacing L7 between the first split-ring resonator 41 and the second split-ring resonator 42 changes from a greater value to a smaller value, the notch width gradually increases. That is, if the value of the spacing L7 is smaller, the range of frequency that may be filtered by the ultra-wideband filter is wider.

In one embodiment, the method further comprises: implementing adjustment of a notch central frequency by adjusting lengths L6 of the first split-ring resonator 41 and the second split-ring resonator 42 to expand a frequency variation range of the notch when a central frequency point of a passband of the filter is fixed.

When the lengths L6 changes from a smaller value to a greater value, the notch central frequency gradually decreases. That is, if the value of the spacing L6 is greater, the frequency that may be filtered by the ultra-wideband filter is lower.

In one embodiment, the method further comprises: adjusting a size and a position of a central frequency point of a passband of the filter by changing sizes of the coplanar waveguide structure 40 and the metal microstrip patch 10.

In one embodiment, the method further comprises: adjusting a size and a position of a central frequency point of a passband of the filter by changing a size of a permittivity of the dielectric plate 20.

One embodiment provides an electronic device, wherein the electronic device comprises the above described filter.

In the several embodiments, it should be understood that the disclosed device and method may be practiced in other manners. The above described device embodiments are merely illustrative. For example, the unit division is merely logical function division and may be other divisions in actual practice. For example, multiple units or components may be combined or integrated into another system, or some features can be ignored or not performed. In addition, the displayed or discussed mutual couplings or direct couplings or communication connections of the various constitutional parts are practiced through some interfaces. The indirect couplings or communication connections between the devices or units may be practiced in electronic, mechanical or other forms.

The units used as separate components may be or may not be physically independent of each other. The element illustrated as a unit may be or may not be a physical unit, that is be either located at a position or deployed on a plurality of network units. A part or all of the units may be selected according to the actual needs to achieve the objectives of the solutions of the embodiments.

In addition, the functional units in the various embodiments may be integrated in one processing unit, or may separately and physically exist as a single unit, or two or more units may be integrated in one unit. The integrated unit may be practiced through hardware, or may also be practiced in a form of hardware plus a software functional unit.

Persons of ordinary skill in the art may understand that all or part of steps according to the embodiments may be executed by a program instructing relevant hardware. The programs may be stored in a computer readable storage medium. When the programs are executed, the steps of the method in the embodiment are executed. The storage medium includes various mediums, such as a mobile storage device, a read-only memory (ROM), a random access memory (RAM), a magnetic disk, a compact disc-read only memory (CD-ROM) or the like media capable of storing program code.

Alternatively, if the integrated unit according to an embodiment, if implemented in the form of a software functional unit and sold or used as a separate product, may be stored in a computer-readable storage medium. Based on such understandings, the technical solutions or part of the technical solutions disclosed that makes contributions to the prior art may be essentially embodied in the form of a software product. The software product may be stored in a storage medium. The software product includes a number of instructions that enable a computer (a PC, a server, a network device, or the like) device to execute all or a part of the steps of the methods provided in the embodiments. The storage media include various media capable of storing program code, for example, a mobile storage device, a ROM, a RAM, a magnetic disk, or a CD-ROM.

The above embodiments are used only for illustrating the present invention, but are not intended to limit the protection scope of the present invention. Various modifications and replacements readily derived by those skilled in the art within technical disclosure of the present invention shall fall within the protection scope of the present invention. Therefore, the protection scope of the present invention is subject to the claims.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

The invention claimed is:

1. A single notch filter, comprising:

a dielectric layer having a first surface and a second surface, wherein the second surface is disposed opposite the first surface;

a first metal layer arranged onto the first surface of the dielectric layer, wherein the first metal layer comprises a metal microstrip patch; and a second metal layer arranged onto the second surface of the dielectric layer, wherein the second metal layer comprises a coplanar waveguide plate and a metal grounding plate, and the coplanar waveguide plate comprises a ground body coupled with the metal microstrip patch, wherein the metal grounding plate surrounds and is not connected to the coplanar waveguide plate and wherein the ground body is located in the center of the coplanar waveguide plate.

2. The single notch filter of claim 1, wherein:

the metal microstrip patch comprises a first patch and a second patch which are symmetrically arranged relative to the center line of the first metal layer;

one end of a first part is connected with the first edge of the first metal layer, and the other end of the first part is connected with one end of a second part, and the other end of the second part is symmetrical with a second part of the second patch relative to the center line of the first metal layer;

one end of a first part of the second patch is connected with a second part of the second patch, while the other end of the first part of the second patch is connected with the second edge of the first metal layer, and the first edge and the second edge are symmetrically arranged relative to the center line of the first metal layer.

3. The single notch filter of claim 1, wherein a stepped impedance resonator is applied to the coplanar waveguide plate.

4. The single notch filter of claim 1, wherein the coplanar waveguide plate comprises a rectangular structure comprising a first part, a second part, and a third part which are connected and sequentially arranged according to the long side, the first part is identical to the third part, and the length of the broadside of the first part is less than that of the broadside of the second part.

5. The single notch filter of claim 4, wherein:

the first part of the coplanar waveguide plate overlaps with the second part of the first patch in the metal microstrip patch relative to the projection of the dielectric layer; and the third part of the coplanar waveguide plate overlaps with the second part of the second patch in the metal microstrip patch relative to the projection of the dielectric layer.

6. The single notch filter of claim 1, wherein the ground body adopts a Y-shaped fractal structure.

7. The single notch filter of claim 6, wherein N-order fractalization is conducted on the Y-shaped fractal structure by applying a two-dimensional image fractal model, and N is a positive integer greater than 1.

8. The single notch filter of claim 1, wherein the value of relative dielectric constant of the dielectric layer ranges from 1 to 100, and the thickness value range is 0.05 to 5 mm.

9. A device, comprising:

a single notch filter;

wherein the single notch filter comprises:

a dielectric layer having a first surface and a second surface, wherein the second surface is disposed opposite to the first surface;

a first metal layer arranged onto the first surface of the dielectric layer, wherein the first metal layer comprises a metal microstrip patch; and a second metal layer arranged onto the second surface, opposite to the first surface, of the dielectric layer, wherein the second metal layer comprises a coplanar waveguide plate and a metal grounding plate, and the coplanar waveguide plate comprises a ground body that is coupled with the metal microstrip patch based on the dielectric layer, wherein the metal grounding plate surrounds and is not connected to the coplanar waveguide plate and wherein the ground body is located in the center of the coplanar waveguide plate.

10. A filter, comprising:

a metal microstrip patch, a dielectric plate having an upper and a lower surface, a metal ground plate, and a coplanar waveguide structure;

wherein the metal microstrip patch applies a microstrip structure, and the metal ground plate applies a defected ground structure;

the metal microstrip patch being disposed on the upper surface of the dielectric plate;

the metal ground plate, coplanar waveguide structure, and a defected ground body being disposed on the lower surface of the dielectric plate, wherein the metal ground plate surrounds and is not connected to the coplanar waveguide plate and wherein the defected ground body is located in the center of the coplanar waveguide plate; and the metal microstrip patch is coupled to the metal ground plate in a vertical transition manner.

11. The filter according to claim 10, wherein the metal microstrip patch is coupled to the metal ground plate in a vertical transition manner such that:

the metal microstrip patch is in contact with the metal ground plate via the dielectric plate, and the metal microstrip patch is normal to the metal ground plate in space.

12. The filter according to claim 10, wherein the metal microstrip patch comprises a first microstrip and a second microstrip; wherein the first microstrip and the second microstrip are in a bilateral symmetric structure, and the first microstrip and the second microstrip are both coupled to the metal ground plate via the dielectric plate.

13. The filter according to claim 10, wherein the coplanar waveguide structure is embedded with a first split-ring resonator and a second split-ring resonator; wherein the first split-ring resonator and the second split-ring resonator have the same ring-splitting direction, and the first split-ring resonator and the second split-ring resonator are symmetrically arranged with respect to a central axis of the coplanar waveguide structure.

14. The filter according to claim 10, wherein the filter further comprises:

a first adjuster, configured to adjust the width and the position of central frequency for the passband of the filter by changing sizes of the coplanar waveguide structure and the metal microstrip patch.

15. The filter according to claim 10, wherein the filter further comprises:

a second adjuster, configured to adjust the width and the central frequency of the passband of the filter by changing the value of permittivity of the dielectric plate.

16. The filter according to claim 13, wherein the filter further comprises:

a processor, configured to form two intersecting resonance frequency points to implement a wide notch according to a coupling and frequency shift relationship based on the relative position between the first split-ring resonator and the second split-ring resonator.

17. The filter according to claim 10, wherein further comprising:

a third adjuster, configured to implement adjustment of the central frequency of a notch by adjusting lengths of a first split-ring resonator and a second split-ring resonator to expand the frequency variation range of the notch when the central frequency of a passband of the filter is fixed.

18. The filter according to claim 10, wherein the coplanar waveguide structure is a stepped impedance resonator.

19. The filter according to claim 10, wherein the dielectric plate has a relative permittivity of 1 to 100 and a thickness of 0.05 to 5 mm.

20. A method, comprising:

forming two intersecting resonance frequency points to implement a wide notch according to a coupling and frequency shift relationship based on the relative position between a first split-ring resonator and a second split-ring resonator;

wherein a filter comprises: a metal microstrip patch, a dielectric plate, a metal ground plate, and a coplanar waveguide structure, wherein the metal ground plate surrounds and is not connected to the coplanar waveguide structure;

wherein the metal microstrip patch applies a microstrip structure, and the metal ground plate applies a defected ground structure, the metal microstrip patch is coupled to the metal ground plate in a vertical transition manner, and the coplanar waveguide structure is embedded with a first split-ring resonator and a second split-ring resonator;

wherein the first split-ring resonator and the second split-ring resonator have the same ring-splitting direction, and the first split-ring resonator and the second split-ring resonator are symmetrically arranged with respect to a central axis of the coplanar waveguide structure.

21. The method according to claim 20, further comprising:

implementing adjustment of a central frequency of a notch by adjusting lengths of the first split-ring resonator and the second split-ring resonator to expand the frequency variation range of the notch when the central frequency of the passband of the filter is fixed.

22. The method according to claim 20, further comprising:

adjusting the width and position of central frequency of the passband of the filter by changing sizes of the coplanar waveguide structure and the metal microstrip patch.

23. The method according to claim 20, further comprising:

adjusting the width and position of central frequency of the passband of the filter by changing the permittivity of the dielectric plate.

* * * * *